US009010010B2

(12) United States Patent
Dreiband

(10) Patent No.: US 9,010,010 B2
(45) Date of Patent: Apr. 21, 2015

(54) FIREARM MAGAZINE CATCH APPARATUS

(71) Applicant: Daniel Isaac Dreiband, Hampstead, MD (US)

(72) Inventor: Daniel Isaac Dreiband, Hampstead, MD (US)

( * ) Notice: Subject to any disclaimer, the term of this patent is extended or adjusted under 35 U.S.C. 154(b) by 0 days.

(21) Appl. No.: 13/834,639

(22) Filed: Mar. 15, 2013

(65) Prior Publication Data

US 2013/0305583 A1 Nov. 21, 2013

Related U.S. Application Data

(60) Provisional application No. 61/649,394, filed on May 21, 2012.

(51) Int. Cl.
*F41C 27/00* (2006.01)
*F41A 9/60* (2006.01)
*F41A 35/00* (2006.01)

(52) U.S. Cl.
CPC ..... *F41C 27/00* (2013.01); *F41A 35/00* (2013.01)

(58) Field of Classification Search
USPC ..... 42/1.01, 90, 94, 98; 89/33.4; 297/16.1, 297/129, 182, 188.2, 440.1, 440.11, DIG. 7; 182/137, 138, 139, 140; 43/7; 224/931; 232/1 R; 119/28.5; 5/110, 111; 383/33; D32/37
See application file for complete search history.

(56) References Cited

U.S. PATENT DOCUMENTS 775,604 A * 11/1904 Kiernan ..... 182/64.1
1,185,568 A 5/1916 Zeunert
2,588,722 A * 3/1952 Hendershott ..... 482/15
3,103,375 A 9/1963 McMullin
3,462,773 A 8/1969 Tripett
3,658,241 A 4/1972 Pistocchi
3,704,850 A 12/1972 Hendrickson et al.
4,296,565 A * 10/1981 Jaffin et al. ..... 42/98
4,865,463 A * 9/1989 Howard ..... 383/33
4,989,749 A * 2/1991 Choi ..... 280/47.34
5,284,280 A * 2/1994 Stonebraker et al. ..... 224/153
5,287,643 A * 2/1994 Arizpe-Gilmore ..... 42/94
5,438,715 A * 8/1995 Jackman ..... 5/110
5,507,577 A * 4/1996 Fowler ..... 383/7
5,876,091 A * 3/1999 Chernomashentsev ..... 297/16.2
6,026,751 A 2/2000 Tsai
6,063,005 A * 5/2000 Schwartz ..... 482/16
6,347,777 B1 2/2002 Webber et al.
6,354,035 B1 3/2002 Niebuhr et al.
6,439,659 B1 * 8/2002 Neubauer, Jr. ..... 297/188.01
6,640,730 B2 11/2003 Tsai
D498,088 S 11/2004 Tsang
6,920,834 B1 7/2005 Pehta et al.
6,951,327 B1 10/2005 Seo
7,152,358 B1 * 12/2006 LeAnna et al. ..... 42/94
7,334,837 B1 2/2008 Long (Continued)

FOREIGN PATENT DOCUMENTS

GB 2157537 A * 10/1985 ..... A01K 1/035
GB 2200035 A * 7/1988 ..... B65F 1/06

*Primary Examiner* — Bret Hayes
(74) *Attorney, Agent, or Firm* — Berenato & White, LLC

(57) ABSTRACT

A firearm magazine catch apparatus is provided. The firearm magazine catch apparatus features a frame including a frame structure and a plurality of legs interconnected by and supporting the frame structure. A flexible collection pouch suspended from the frame has an open top and walls sloping from an edge of the frame structure to a central area of the frame structure for catching firearm magazines discharged from a firearm.

18 Claims, 9 Drawing Sheets

(56) References Cited

U.S. PATENT DOCUMENTS

| | | | | |
|---|---|---|---|---|
| 8,272,337 | B2 | 9/2012 | Carter | |
| 2003/0221354 | A1 | 12/2003 | Goza et al. | |
| 2004/0053747 | A1* | 3/2004 | Bollinger | 482/15 |
| 2006/0071532 | A1* | 4/2006 | Hsieh | 297/440.11 |
| 2007/0277709 | A1* | 12/2007 | Carter | 108/115 |
| 2009/0174233 | A1* | 7/2009 | Hoffman et al. | 297/16.2 |
| 2010/0207429 | A1* | 8/2010 | Quinn | 297/16.1 |
| 2011/0148155 | A1* | 6/2011 | Chapman et al. | 297/16.1 |

* cited by examiner

FIREARM MAGAZINE CATCH APPARATUS

CROSS-REFERENCE TO RELATED APPLICATION(S) AND CLAIM OF PRIORITY

This application claims the benefit of priority of provisional application No. 61/649,394 of Daniel Isaac Dreiband filed on May 21, 2012 entitled "Mag-Change Catch-All," the complete disclosure of which is incorporated herein by reference.

FIELD OF THE INVENTION

This invention relates to an apparatus for collecting spent magazine cartridges discarded from a firearm, especially an Airsoft firearm, and in certain embodiments for also collecting projectiles discharged during magazine cartridge changes.

BACKGROUND

Although the sport of Airsoft is not new, it has seen a tremendous increase in popularity over the past five or more years due to technological developments. Airsoft guns are now carried by major retail chains. One of the greatest lures to Airsoft is the realism of the weapons. Other than a three-quarter inch orange muzzle mandated by law on the tip of Airsoft weapons, Airsoft weapons look and feel very much like their live ammunition, genuine counterparts. Indeed, Airsoft gun velocity ranges from lower end plastic Airsoft pistols shooting rounds at approximately 150 fps all the way up to high-powered all metal Airsoft rifles shooting rounds at 600 fps. With technological advances, it may be that even higher round velocities will be reached in the future. Airsoft firearms also are able to fire projectiles at high rates of repetition, for example, approximately 1200 rounds per minute (RPM), by equipping Airsoft firearms with magazines that store and automatically load ammunition into the barrel of the firearm.

Proper handling, training, and transport are important where Airsoft safety is concerned and diligent promotion of safety habits is crucial to the future welfare of the Airsoft sport. Training involves not just target practice, but proper handling of the firearm. For example, given the high RPM that can be achieved by Airsoft firearms, it is important that the user be well trained in properly loading, ejecting, and reloading magazines into the firearm. As with real guns, when the magazine of an Airsoft weapon is depleted, it is not unusual for the user to allow the spent magazine to fall—e.g., about 5 feet from chest level of a person in a standing position—to the ground. Magazine change drills in particular involve quick magazine changes in which the spent magazine is allowed to fall to the ground to save time as the firearm operator frees his or her hands to reload a new magazine into the Airsoft firearm. Other times, a magazine may be accidentally dropped, such as in the case of a less experienced shooter who fails to properly load and lock the magazine into the firearm.

Despite the realism of Airsoft equipment, many Airsoft weapon magazines lack the durability of and are much more fragile than their genuine firearm components. Airsoft magazines may contain springs, gas seals, and/or plastic components that are prone to damage when the magazine is ejected from the Airsoft firearm and allowed to fall to the ground. For example, if a gas magazine falls about five feet, such as from chest firing level to the ground, a gas seal may be broken, resulting in a gas leak, or the magazine may be otherwise damaged severely enough to prevent its reuse. Many Airsoft shooters lack the know-how and/or tools to fix such damage, and as a result must replace the magazines, which can be expensive.

Another problem associated with Airsoft weapon magazine usage, particular those magazines used with Air Electric Guns (AEGs), is ammunition spillage accompanying magazine ejections. The majority of Airsoft weapons are AEGs. AEGs include rifles, carbines, machine guns (MGs), submachine guns (SMGs), and personal defense weapons (PDWs), among other firearms, powered by a battery or other source of electricity. The standard design incorporates a hop-up unit that acts as a feeding mechanism for loading the projectiles (e.g., typically BBs) from the magazine and into the barrel of the AEG. The hop-up housing is configured to leave a small gap or dead space of about 12-18 mm between the feed lip of the magazine and the AEG barrel. BBs are typically about 6 mm in diameter. Hence, at any time about 2 to 3 BBs are typically being passed through this dead space, where the BBs are neither in the magazine nor loaded in the firearm. Even when the magazine is depleted of BBs, the last few BBs discharged from the magazine will not be fed to the firearm, but will remain in this dead space. Consequently, removal of the magazine causes BBs in the dead space to fall freely and spill to the ground. BBs left unattended on the ground can create a potential safety hazard and an unsightly mess.

SUMMARY OF THE INVENTION

According to a first aspect of the invention, a firearm magazine catch apparatus features a frame and a flexible collection pouch suspended from the frame. The frame includes a frame structure and a plurality of legs interconnected by and supporting the frame structure. The frame structure includes a plurality of arms that collectively form an upper opening, the arms including adjacent first and second sloping arms. The flexible collection pouch includes an open top and a plurality of walls. The open top is defined by a plurality of top edges overlying the plurality of arms, the top edges including a first top edge that slopes downward over the first and second sloping arms to establish a depression along the first top edge, and a non-sloping second top edge on an opposite side of the upper opening relative to the first upper edge. The walls slope from the top edges to a central area of the frame structure for catching firearm magazines discharged from a firearm.

A second aspect of the invention provides a firearm magazine catch apparatus featuring a frame and a flexible collection pouch suspended from the frame for catching firearm magazines discharged from a firearm. The frame includes a truss frame structure and a plurality of legs interconnected by and supporting the truss frame structure. The truss frame structure is movable between a deployed extended state and a stowed collapsed state, and includes a plurality of arms that collectively form an upper opening. In the deployed extended state, the arms on a first side of the truss frame structure include adjacent first and second sloping arms. The flexible collection pouch includes an open top and a plurality of walls. In the deployed extended state, the open top of the flexible collection pouch is defined by a plurality of top edges overlying the plurality of arms, the top edges include a first top edge that slopes downward over the first and second sloping arms to establish a depression along the first top edge and a non-sloping second top edge on an opposite side of the upper opening relative to the first upper edge, and the walls of the flexible collection pouch slope from the top edges to a central area of the frame structure for catching firearm magazines discharged from a firearm.

Other aspects of the invention, including other assemblies, apparatus, devices, sub-assemblies, kits, methods, processes, and the like which constitute part of the invention, will become more apparent upon reading the following detailed description of the exemplary embodiments.

BRIEF DESCRIPTION OF THE DRAWING(S)

The accompanying drawings are incorporated in and constitute a part of the specification. The drawings, together with the general description given above and the detailed description of the exemplary embodiments and methods given below, serve to explain the principles of the invention. In such drawings.

DETAILED DESCRIPTION OF THE EXEMPLARY EMBODIMENTS AND EXEMPLARY METHODS

Figure 1:
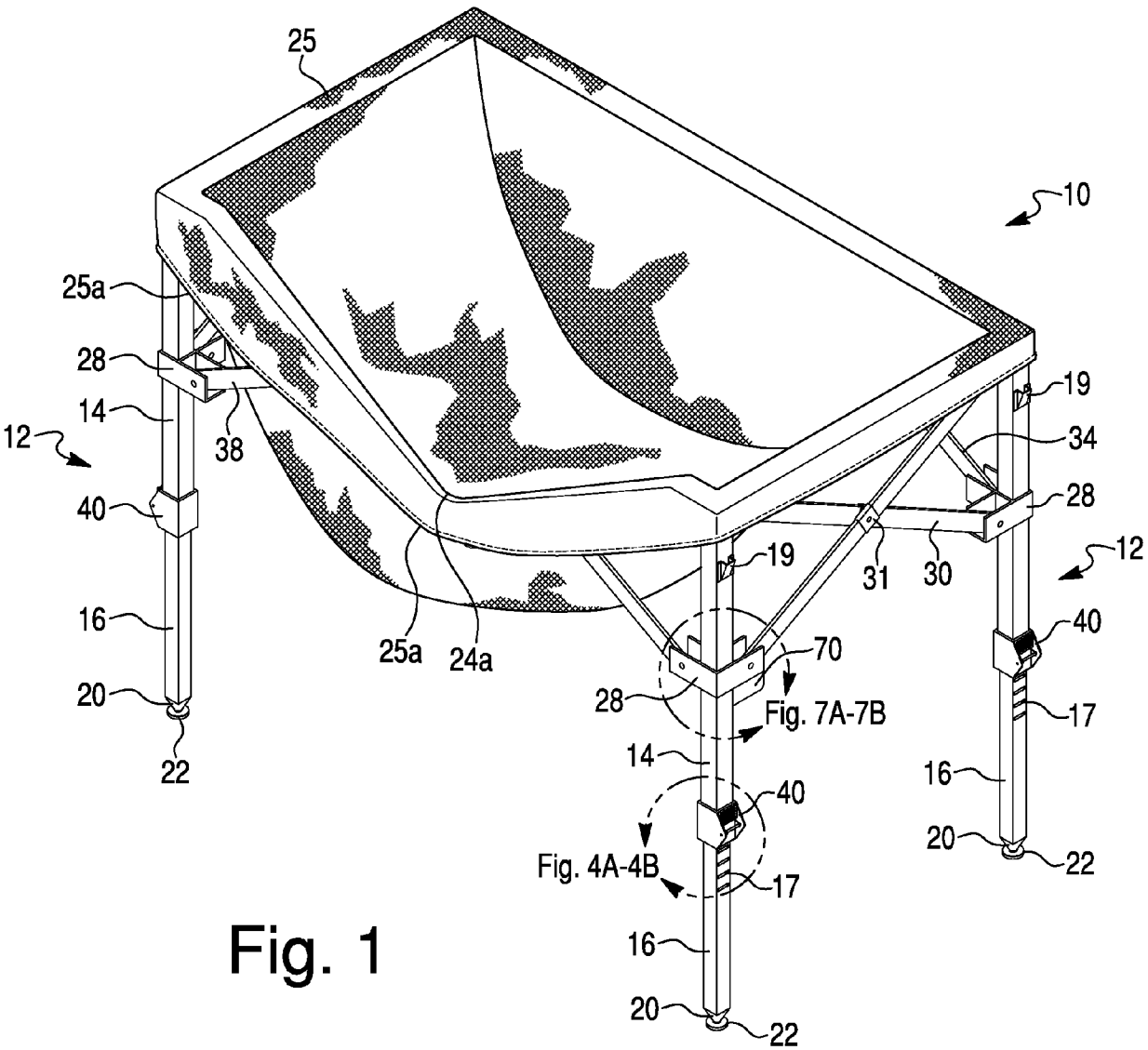
FIG. 1 is a perspective view of a firearm magazine catch apparatus of an exemplary embodiment, the apparatus including a flexible catch bin and a collapsible frame shown in a deployed extended state.

Reference will now be made in detail to exemplary embodiments and methods of the invention. It should be noted, however, that the invention in its broader aspects is not necessarily limited to the specific details, representative materials and methods, and illustrative examples shown and described in connection with the exemplary embodiments and methods. Like reference numerals are used to designate like parts throughout the drawings.

Figure 2:
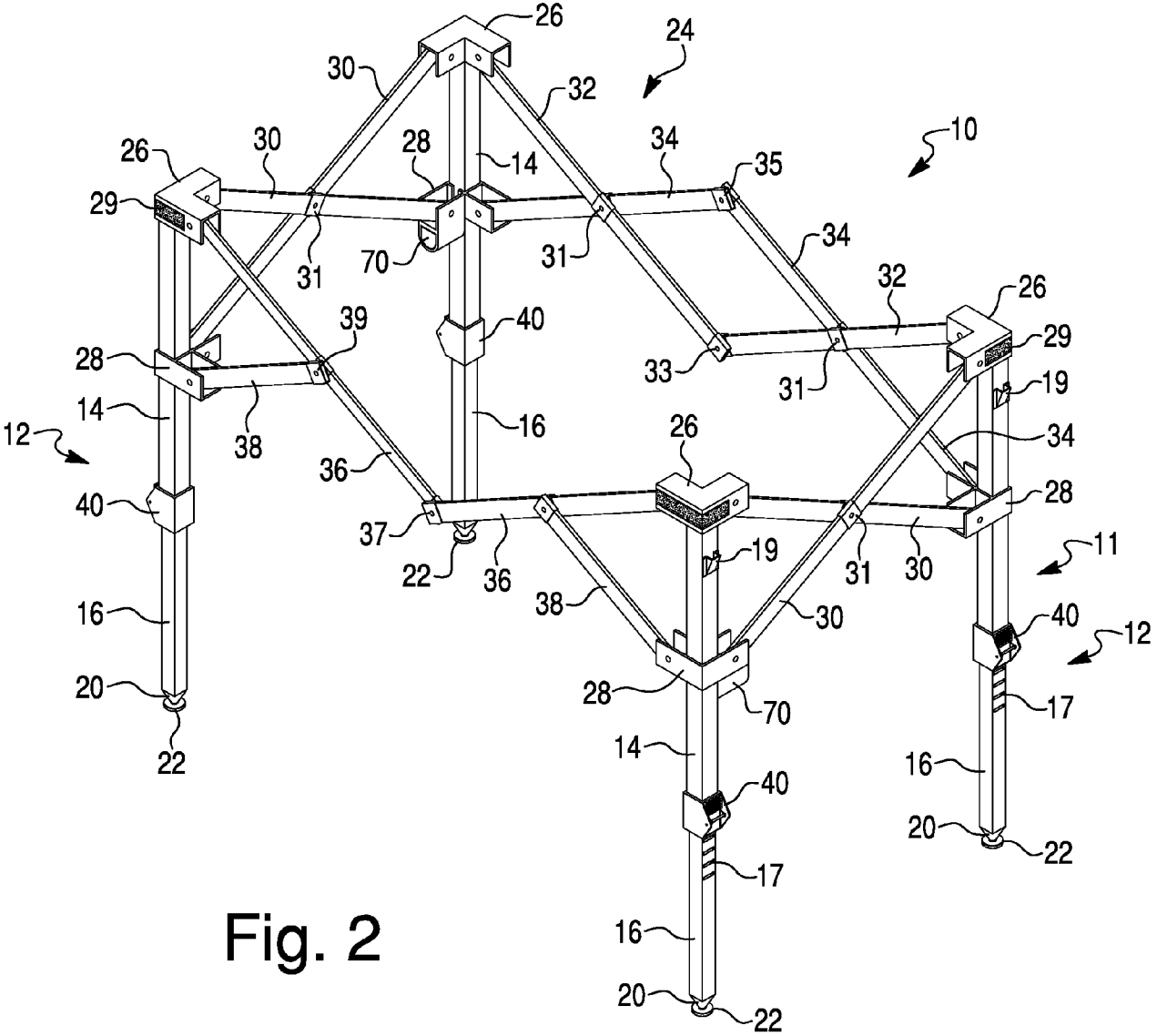
FIG. 2 is a perspective view of the collapsible frame of the firearm magazine catch apparatus of FIG. 1 shown in the deployed extended state.
Figure 3:
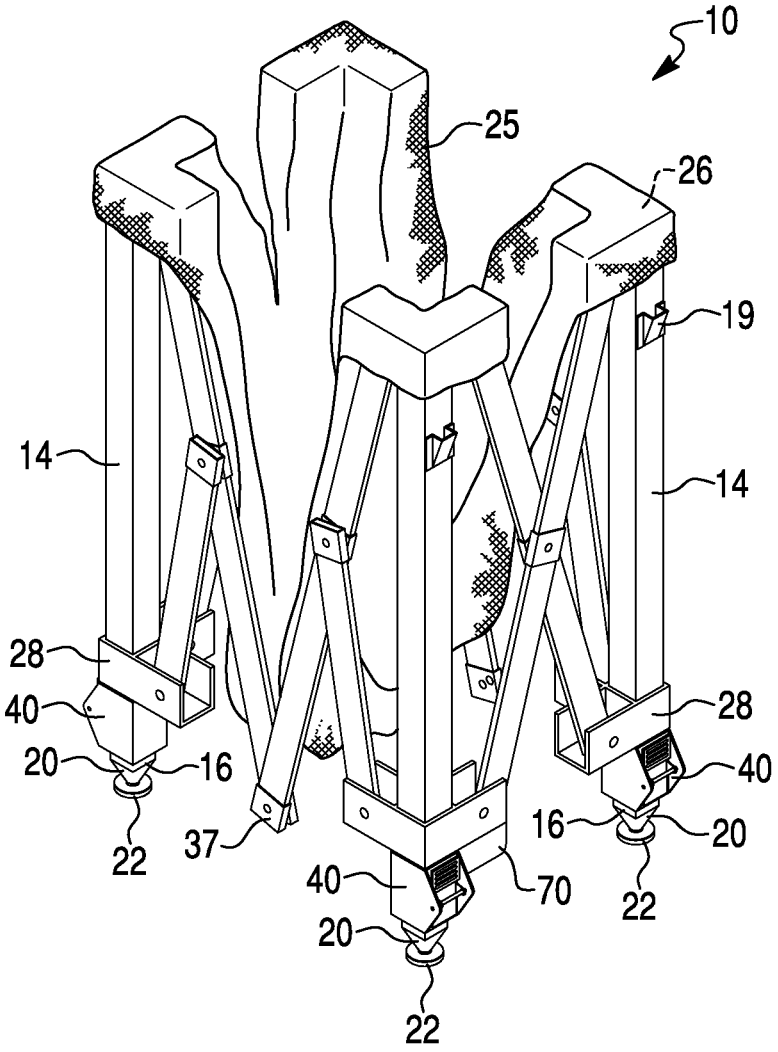
FIG. 3 is a perspective view of the collapsible frame of the firearm magazine catch apparatus of FIG. 1 shown in a stowed collapsed state.

Referring now more particularly to the drawings, a firearm magazine catch apparatus of an exemplary embodiment is generally designated by reference numeral 10 in FIGS. 1-3.

The firearm magazine catch apparatus 10 includes an adjustable and collapsible frame 11 including four vertically disposed legs 12. It should be understood that the apparatus 10 may include fewer or more legs 12, and that the number of legs 12 may depend upon or be influenced by the shape of the apparatus 10. To permit height adjustment to the apparatus 10, each of the legs 12 in the illustrated embodiment includes an upper leg component 14 and a lower leg component 16 movable in telescoping relationship with the upper leg component 14. Although the upper leg component 14 is shown telescopingly receiving the lower leg component 16 in the figures, it should be understand that the relationship may be reversed, so that the lower leg component 16 is wider than and receives the upper leg component 14 for allowing telescoping movement. The legs 12 may be made of three, four, or more telescoping leg components rather than the two shown. It also is within the scope of the invention to use movable relationships other than telescoping, such as folding relationships, between the upper and lower leg components 14, 16. Alternatively, the legs 12 each may be made of a single, integral component that does not telescope, fold or otherwise allow for change to the height of the apparatus 10.

The legs 12 as illustrated are hollow tubular members having square cross sections. Although the dimensions may vary depending upon the desired size of the apparatus 10, it is envisioned that the upper leg components 14 may be approximately 1 inch width by 1 inch depth, and the lower leg components 16 slightly smaller (e.g., about 13/16 to 7/8 inch width by 13/16 to 7/8 inch depth) to permit telescoping sliding of the lower leg components 16 within their respective upper leg components 14. It should be understood that the illustration of the legs 12 in the drawings is exemplary, and that the legs 12 may be round, tapered, or possess other shapes and structures. The legs 12 may be non-vertical, i.e., slanted or flared, in the deployed state and/or the stowed state. The upper and lower leg components 14, 16 may be made of, for example, lightweight metal, reinforced or high impact plastic, or composites. Unless otherwise indicated, other components of the collapsible frame 11 may be made of metals, particularly lightweight metals and metal alloys, plastics such as reinforced and high impact plastic, other polymeric materials, composite materials including for example fiberglass impregnated polymers, other suitable materials, or any combination thereof. The materials may be selected to provide the apparatus with a relatively light weight, for example 10 pounds or less total weight, and with consideration given to cost, strength, and durability.

Attached to the bottom of each of the legs 12 are a respective swivel foot mount 20 and an associated foot 22. Each of the swivel foot mounts 20 may be constructed of a metal or high strength plastic to allow swiveling movement of the associated foot 22. Hence, when the apparatus 10 is deployed on an uneven surface, such as a hill, the feet 22 may be swiveled and the respective lengths of each leg 12 may be adjusted to compensate for the topography of the uneven surface on which the apparatus 10 is placed, so that the apparatus 10 may be level. The feet 22 may be constructed of a metal or high strength plastic, and optionally may include a pad, such as a rubber or foam, on their bottoms to provide scuff resistance.

The collapsible frame 11 further includes a truss structure generally designated by reference numeral 24 in FIG. 2. A flexible catch bin 25 is suspended from the collapsible frame 11 to hang above the ground. The truss structure 24 and flexible catch bin 25 are discussed in greater detail below.

As mentioned above, in the illustrated embodiment the lower leg component 16 slides inside the upper leg component 14 to provide the telescoping movement and height adjustability. The lower leg component 16 may be configured to fit entirely within the upper leg component 14 for improved stowage. In the embodiment shown in FIGS. 1-4, a locking mechanism 40 is provided for each of the legs 12 for preventing the sliding telescoping movement and thereby retaining the relative positions between the upper leg component 14 and the lower leg component 16 at a selected height. The locking mechanisms 40 engage with lock slots 17 formed in the outer face of the lower leg component 16. Each lower leg component 16 includes a plurality of lock slots 17 vertically spaced from one another to provide height selectability.

Figure 4A:
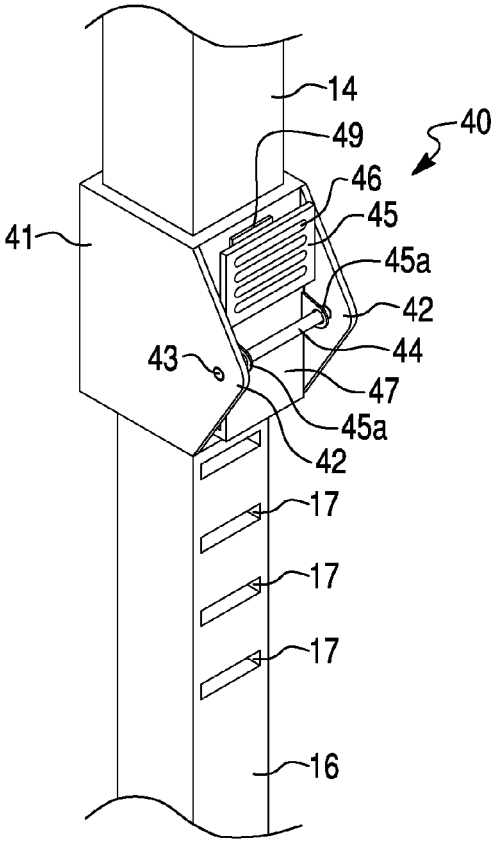
FIGS. 4A and 4B are respectively front perspective and side sectional views of a lock tab of the collapsible frame of FIGS. 1-3.
Figure 4B:
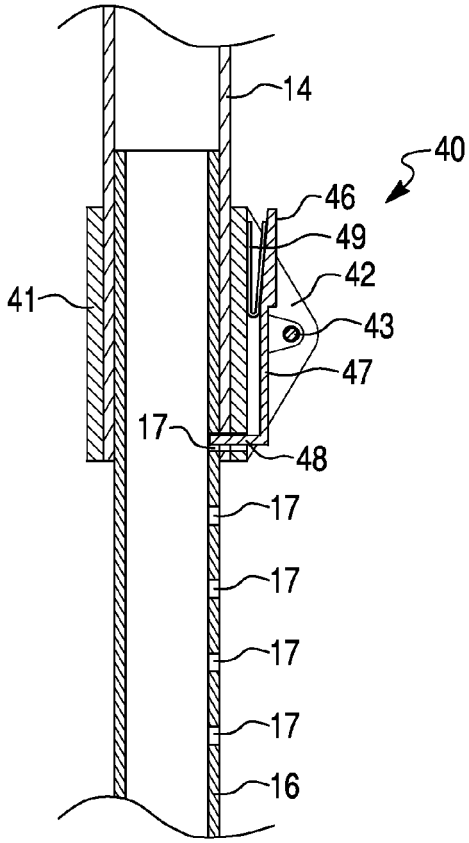

FIGS. 4A and 4B provide an enlarged view of the locking mechanisms 40 of the exemplary embodiment of FIGS. 1-3. The locking mechanisms 40 associated with each of the legs 12 in FIGS. 1-3 are identical to one another. Accordingly, only one of the locking mechanisms 40 is discussed below with reference to FIGS. 4A and 4B, although it should be understood that the discussion applies equally to the locking mechanisms 40 of the other legs 12.

The locking mechanism 40 includes a stationary lock mount sleeve 41 located at the bottom of the upper leg component 14. The lock mount sleeve 41 may be secured to the upper leg component 14 with a fastener (e.g., screws, bolts, rivets, etc.), an adhesive, welding and/or by pressure fit. The lock mount sleeve 41 has a rectangular cross section with a hollow central area that receives the upper leg component 14 without obstructing downward telescoping movement of the lower leg component 16. Generally triangular brackets 42 extend from opposite side edges of the lock mount sleeve 41. The brackets 42 may be integrally formed with the lock mount sleeve 41 as a unitary piece, or may be fastened or welded to the lock mount sleeve 41. The brackets 42 include apertures 43 aligned with one another. A locking pin 44 is received and secured in the apertures 43 so that the axis of the locking pin 44 is in a slightly spaced and parallel relationship to an outer face of the lock mount sleeve 41. The locking pin 44 may be, for example, a metal retention pin, a hinge pin, a nut-and-bolt arrangement, etc. A locking lever 45 includes outwardly extending flanges 45*a* approximately at the midpoint of the length of the locking lever 45. The flanges 45*a* each have an aperture through which the locking pin 44 passes, such that the locking pin 44 functions somewhat like a fulcrum for the locking lever 45. An upper portion of the locking lever 45 above the locking pin 44 is a thumb-sized push tab 46. A lower portion of the locking lever 45 below the locking pin 44 is a latch plate 47 including a locking tip or protuberance 48 at its distal end. In a locked position, the protuberance 48 of the latch plate 47 is seated and retained in a preselected lock slot 17 of the lower leg component 16. The locking mechanism 40 further includes a biasing member 49 such as a metal coil spring or leaf spring to apply force to the back of the push tab 46. The force imparted by the biasing member 49 against the back of the push tab 46 urges the opposite end of the locking lever 45, that is the latch plate 47 below the fulcrum, towards the lower leg component 16 so that the protuberance 48 remains seated in engagement with a lock slot 17. When the protuberance 48 is seated in the lock slot 17, telescoping movement of the lower leg components 16 is prevented.

As best shown in FIG. 2, the locking levers 45 are arranged to face outward from the opposite ends of the apparatus 10 to allow easy access of the push tabs 46 by the user for leg height adjustment. The height of the leg 12 is adjusted by pressing on the push tab 46, for example with the user's thumb, to rock the lever 45 about the locking pin 44 and thereby unseat the protuberance 48 from the selected lock slot 17. When the protuberance 48 is unseated from the lock slot 17, the leg 12 may be adjusted to its desired height (as the push tab 46 remains depressed) by telescopingly sliding the lower leg component 16 relative to the upper leg component 14 to another lock slot 17 corresponding to the desired leg height. The push tab 46 is then released to allow the biasing member 49 to urge the protuberance 48 into engagement with the newly selected lock slot 17 as the locking lever 45 pivots about the locking pin 44. Leg height is increased by seating the protuberance 48 in one of the lock slots 17 located higher up along the lower leg component 16, and is decreased by seating the protuberance 48 in one of the slots 17 lower down along the height of the lower leg component 16. The lower leg components 16 may each include identical numbering or other indicia to facilitate setting the legs 12 at identical heights. By way of example, the telescoping movement of the lower leg component 16 in this and other exemplary embodiments described herein may allow adjustment of the total height of the apparatus 10 from about 66 cm (about 26 inches) to about 92 cm (about 36 inches).

Figure 5A:
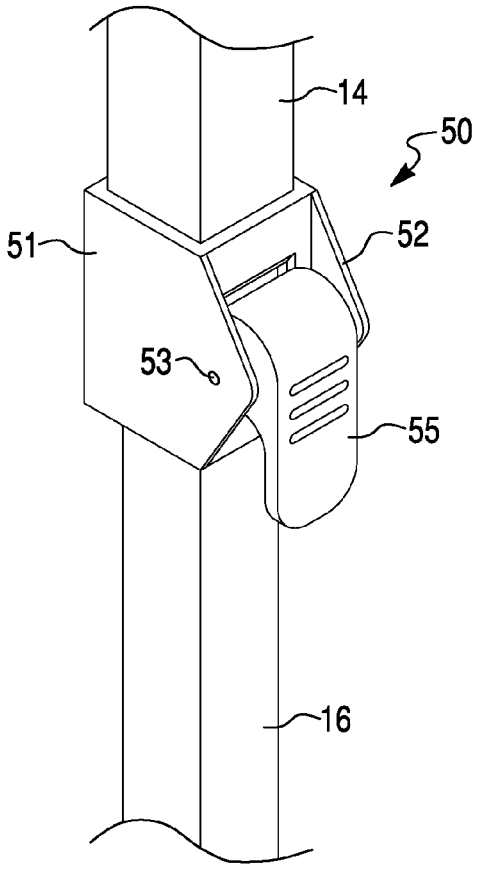
FIGS. 5A and 5B are respectively front perspective and side sectional views of an alternative embodiment of a lock tab for the collapsible frame of FIGS. 1-3.
Figure 5B:
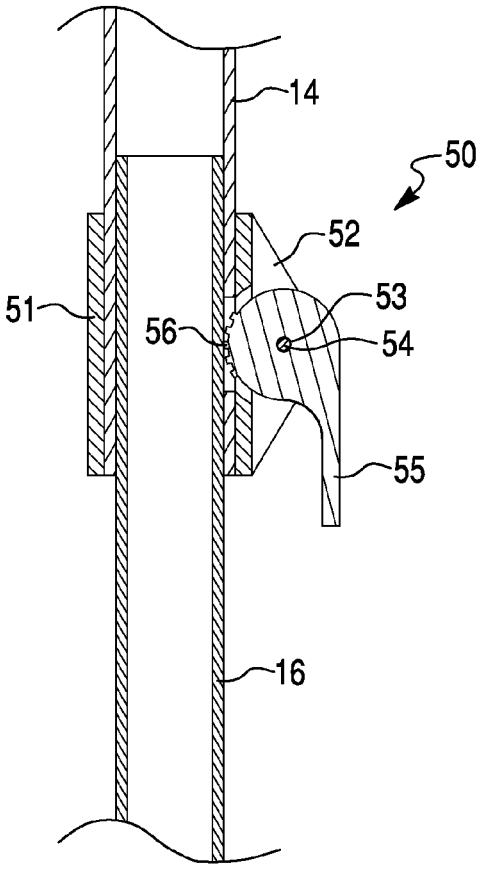

FIGS. 5A and 5B provide enlarged views of a locking mechanism 50 that can be substituted for one or more of the locking mechanisms 40 of the apparatus of FIGS. 1-3. The locking mechanism 50 includes a lock mount sleeve 51 located at the bottom of the upper leg component 14. The lock mount sleeve 51 may be secured to the upper leg component 14 with a fastener, adhesive, weld, and/or by pressure fit. The lock mount sleeve 51 has a rectangular cross section with a hollow central area that receives the upper leg component 14 without obstructing downward telescoping movement of the lower leg component 16. Triangular brackets 52 are integrally formed with or are fastened or welded to the lock mount sleeve 51 to extend from opposite sides of the lock mount sleeve 51. The brackets 52 include aligned apertures 53 receiving a locking pin 54 in a slightly spaced and parallel relationship to an outer face of the lock mount sleeve 51. The locking pin 54 may be a metal retention pin, hinge pin, or bolt and nut arrangement, for example.

A locking lever 55 has a backside surface including inward cams with aligned apertures (unnumbered) that receive the locking pin 54, about which the lever 55 articulates. The curved edges of the cams of the locking lever 55 include cam ridges or bulges 56. The locking lever 55 may be configured as a thumb-sized push/pull tab. When the locking lever 55 is pushed downward (such as with the user's thumb) into the position shown in FIGS. 5A and 5B, the cam ridges 56 on the cams of the locking lever 55 act as cam locks, cooperating with the mount sleeve 51 to create a tight pressure fit on opposite sides of the leg 12 that clamps the upper and lower leg components 14, 16 together and thereby prevents telescoping movement of the lower leg component 16. Lifting, that is flipping up, the locking lever 55 to pivot about the locking pin 54 disengages the clamping pressure fit created by the cam ridges 56, allowing telescoping sliding movement of the lower leg component 16 relative to the upper leg component 14 to a desired leg height. Once a desired leg height is attained, the locking lever 55 is flipped down again to reestablish the cam lock. It should be noted that the locking mechanism 50 may be used without guide holes 18 (FIGS. 6A and 6B) or lock slots 17 (FIGS. 4A and 4B) in the upper or lower leg components 14, 16.

Figure 6A:
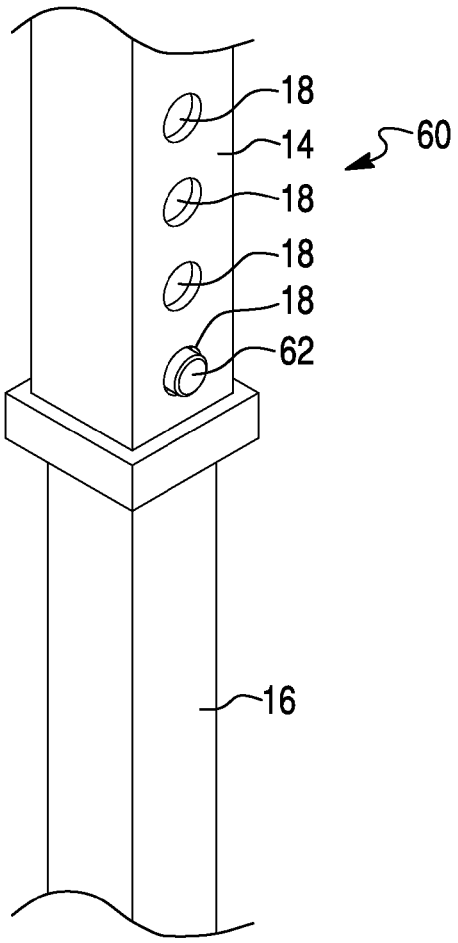
FIGS. 6A and 6B are respectively front perspective and side sectional views of another alternative embodiment of a lock tab for the collapsible frame of FIGS. 1-3.
Figure 6B:
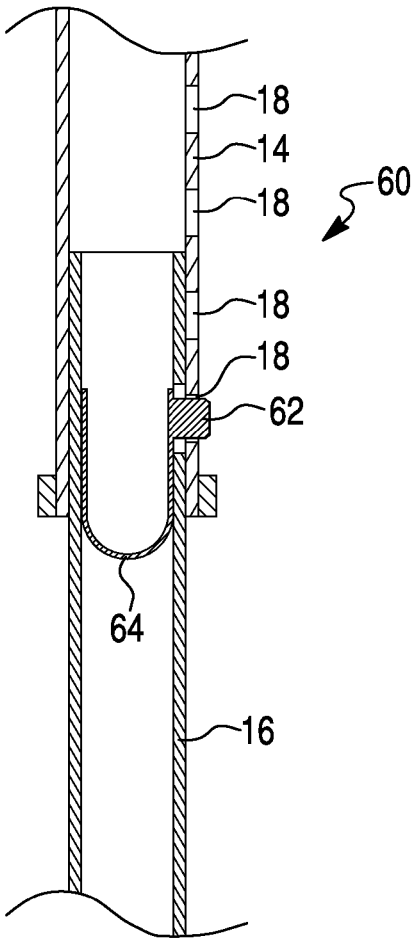

FIGS. 6A and 6B provide enlarged views of another locking mechanism 60 that can be substituted for one or more of the locking mechanisms 40 and/or 50 of the apparatus 10 of FIGS. 1-5. Instead of lock slots 17 in the lower leg component 16, the embodiment of FIGS. 6A and 6B makes use of guide holes (also referred to as height adjustment guides) 18 in the upper leg component 14. The guide holes 18 are uniformly spaced apart from one another along a portion of the height of the upper leg component 14 to provide multiple leg height settings from which to choose. The locking mechanism 60 includes a lock button 62 associated with and protruding through a hole (also referred to as a lock button guide) in the outer face of the tubular housing of the lower leg component 16. The lock button 62 is urged into this protruding position by a lock button biasing member 64 such as a compression spring or leaf spring, which is housed inside the lower leg component 16 and attached to the lock button 62.

The height adjustment guides 18 are slightly larger in diameter than the lock button 62 so that each of the guides 18 may receive the lock button 62 in a relatively snug relationship. The lower leg component 16 is slid in a telescoping manner in the upper leg component 14 by depressing the lock button 62 (e.g., by the user's thumb) as the button 62 passes by each of the height adjustment guides 18. When the lock button 62 reaches a selected height adjustment guide 18, the lock button 62 is released, permitting the biasing member 64 to urge the lock button 62 to protrude through the selected height adjustment guide 18 and lock the lower leg component 16 in place relative to the upper leg component 14.

It should be understood that other locking mechanisms may be used in place of or to supplement one or more of the above-described mechanism 40, 50, 60. For example, the locking mechanism may include a lock mount sleeve and a manually adjustable tension knob for applying a clamping pressure (or fitting a retaining screw into height adjust guides) that secures the lower leg component 16 in place relative to the upper leg component 14.

The collapsible frame 11 includes stationary support mounts (shown as end caps) 26 and slidable sleeve mounts 28. Each of the upper leg components 14 is associated with a respective one of the stationary support mounts 26 positioned at the top of the upper leg component 14. A respective one of the slidable sleeve mounts 28 is positioned on the upper leg component 14 below the corresponding stationary support mount 26. The stationary support mounts 26 may be fastened (e.g., rivets, nuts and bolts, screws, etc.), welded and/or adhered to the top of the upper leg components 14. The sleeve mount 28 wraps around the upper leg component 14 and is slidable along at least a portion of the length of the upper leg component 14 for transitioning the apparatus 10 between its deployed extended state (FIGS. 1 and 2) and its stowed collapsed state (FIG. 3). The slidable sleeve mount 28 has a central square aperture to permit the slidable sleeve mount 28 to fit around and slide along the shaft of the upper leg component 14. The slidable sleeve mount 28 may be made of a plastic or other material.

When the collapsible frame 11 is in the deployed extended position shown in FIGS. 1 and 2, the illustrated firearm magazine catch apparatus 10 viewed in plan is generally rectangular. For convenience sake, the longer edges of the rectangle are referred to herein as "sides" of the apparatus 10 and the shorter edges of the rectangle are referred to as "ends" of the apparatus 10. By way of example, the "sides" of the apparatus 10 may be about 102 cm (about 40 inches) in length and the "ends" (or depth) of the apparatus 10 may be about 56 cm (about 22 inches) in length. Other dimensions may be practiced. It should be understood that the truss structure 24 may have equal length sides and ends to provide a square configuration when viewed in plan.

The truss structure 24 includes pairs of truss extension arms 30 at the opposite ends of the apparatus 10. Each truss extension arm 30 extends between the adjacent legs 12 at the same end of the apparatus 10. One end of each truss extension arm 30 is pivotally connected to the stationary support mount 26 of one of the legs 12, while the opposite end of the same truss extension arm 30 is pivotally connected to the slidable sleeve mount 28 of the adjacent leg 12 at the same end of the apparatus 10. These pivotal connections may be formed in known manner, such as using a metal retention pin, hinge pin, or bolt and lock nut set, wherein the opposite ends of the extension arms 30 have holes through which the pin or bolt is received. For both pairs, the truss extension arms 30 are pivotally connected to one another in a scissors configuration by a midpoint connector/joint 31 at the midpoint between the opposite ends of the extension arms 30. The midpoint connector 31 is also referred to as an X-hinge, and can be a pin, and bolt-and-nut combination, or other suitable fastener or design.

The "sides" of the truss structure 24 differ in design from the "ends" discussed above. For convenience, the illustrated firearm magazine catch apparatus 10 of FIG. 2 is referred to as having a "front side" and a "rear side." In FIG. 2, the "front side" appears closer to the viewer than (and left relative to) the "rear side." The respective structures of the "front side" and the "rear side" differ from one another, as explained below.

The "rear" side of the truss structure 24 includes two pairs of long extension arms 32, 34. The first pair includes long extension arms 32 having their upper ends pivotally connected to the stationary support mounts 26 of the corresponding upper leg components 14. The lower ends of the first pair of long extension arms 32 on the "rear side" of the apparatus 10 are pivotally connected to one another by a connector/joint 33 also referred to as a "V"-hinge or "L"-hinge. The connector 33 is positioned at the midpoint of the "rear side" of the apparatus 10. The second pair of long extension arms 34 have their lower ends pivotally connected to the slidable sleeve mounts 28 of the corresponding upper leg components 14. The upper ends of second pair of the long extension arms 34 are pivotally connected to one another on the "rear side" by a connector/joint 35, which again may be a "V"-hinge or "L"-hinge. Like connector 33, the connector 35 is positioned at the midpoint of the length of the "rear side" of the apparatus 10. The "rear side" also includes two X-hinges 31. Each X-hinge 31 is positioned at crossing midpoints of the long extension arms 32, 34 associated with a common upper leg component 14. The pivotal connectors/joints 31, 33, 35 for the long extension arms 32, 34 may be formed in known manner, such as using a metal retention pin, hinge pin, or bolt and lock nut set, etc., wherein the ends and midpoints of the long extension arms 32, 34 have holes through which the connectors 31, 33, 35 are received.

The "front side" of the truss structure 24 includes a pair of long extension arms 36 and a connector/joint 37 that are essentially the same as the long extension arms 32 and connector 33 of the "rear side" described above. The "front side" also includes a pair of short extension arms 38. Each of the short extension arms 38 has a lower end pivotally connected to a corresponding one of the slidable sleeve mounts 28, and an upper end pivotally connected to the midpoint of a respective one of the long extension arms 36 by a connector/joint 39 (e.g., another "X"-hinge).

As shown in FIG. 2 and discussed above, the "front side" of the truss structure 24 is structurally different than the "rear side." The "front side" has short extension arms 38 that terminate at the X-hinges 39, whereas the "rear side" has long extension arms 34 which meet at a higher point at L-hinge 35. As a result, the upper edge of the "front side" of the truss structure 24 has a trench-like depression area or furrow **24*a* extending in a continuous downward pitch from the stationary support mounts 26 on a midpoint of the length of the "front side" to of the truss structure 24. As shown in FIG. 1, the flexible catch bin 25 overlying this front side upper edge has a front upper edge that likewise forms a trench-like depression area. In contrast, vertical alignment between the connector/joint 35 and the stationary support mounts (caps) 26 on the "rear side" of the truss structure provides a generally horizontal upper edge to the flexible catch bin 25 (FIG. 1) extending non-sloping (taut) across the "rear side" of the truss structure. The depression 24*a* defines a V-shaped notch at the top of the "front side" of the truss structure 24. The bottom of the V-shaped notch may be, for example, spaced less than about 61 cm (about 2 feet) from the ground, for example about 45 cm (about 18 inches) to about 51 cm (about 20 inches) from the ground, and/or about 25 cm (about 10 inches) to about 30 cm (about 12 inches) below the top edge of the frame 11. The depression 24***a* facilitates primary to second weapon transitions, as discussed in greater detail below. It should be understood that the truss structure 24 may be structured to produce other shapes (e.g., U-shape) depressions 24*a* or multiple depressions.

The flexible catch bin 25 may be a sheet or bag draped over and suspended from the collapsible frame 11 to establish a pouch or basin-shaped structure with walls sloping from the edge of the frame 11 to the approximate center of the catch bin 25. The edge of the flexible catch bin 25 may wrap over and rest along the top of the collapsible frame 11. When suspended from the frame 11, the flexible catch bin 25 hangs loose in a general concave shape as the sides of the catch bin 25 slope inward towards the bottom center of the bin 25, which may hang, for example, about 1.5 feet from the upper edge of the collapsible frame 11. In conjunction with the remainder of the firearm magazine catch apparatus 10 embodied in FIG. 1, the catch bin 25 is designed to address one or more problems discussed in the Background section above by providing a wide opening and sloping walls that establish a soft, sloping catch area for spent magazines and BBs that are dropped during magazine changes. At the same time, the catch bin 25 may be made of a material having durability and strength to hold at least six to eight Airsoft rifle magazines. For example, the catch bin 25 may be made of a fabric or mesh sheet. Nylon, polyester, and canvas are examples of flexible materials from which the catch bin 25 may be made. The materials may be uncoated or coated, e.g., with vinyl.

Hook-and-loop fasteners (e.g., Velcro®) may be used to secure the catch bin 25 to the collapsible frame 11. For example, as best shown in FIG. 2, the collapsible frame 11 includes hook interface areas 29 on the outer faces (i.e., facing away from the bin) of the stationary support mounts 26. The L-shaped hinges 33, 35, 37 likewise may be provided with hook interface areas. The hook interface areas 29 may be permanently adhered to the collapsible frame 11. "Loop" interface areas are attached at corresponding locations on the bottom, surface of the catch bin 25, particularly along its corners and edges. The "loop" interface areas may be part of a strip, for example a one inch (1") strip, adhered, sewn, or otherwise fastened to the bottom surface of the catch bin 25. Alternatively, the hook interface areas may be attached to the bottom surface of the catch bin 25, and the loop interface areas may be secured on the collapsible frame 11 at, for example, the stationary support mounts 26 and the L-shaped hinges 33, 35, 37. The hook-and-loop fasteners facilitate quick attachment and detachment of the batch bin 25 to and from the frame 11. The catch bin 25 wraps over the edges of the collapsible frame 11, including the tops of the stationary support mounts 26, to engage the hook and loop fasteners to one another. At the same time, the fasteners maintain the walls of the catch bin 25 in a gradually sloping orientation so that falling magazines and BBs are gently caught and funneled to the center of the bin 25. It should be understood that other fasteners, such as clips, clamps, etc., may be used instead of or to supplement the hook-and-loop fasteners.

The outer edge of the catch bin 25 may be reinforced with a reinforcement edging 25*a* to stiffen, define, and protect the edges of the catch bin 25. The reinforcement edging 25*a* can be relative narrow, for example, approximately ¼ inch in width. The reinforcement edging 25*a* may be constructed of heavy duty fabric, duck, Cordura, leather, or a synthetic material, which may be permanently attached (e.g., sewn or adhered) to the catch bin 25.

The firearm magazine catch apparatus 10 is movable between the deployed extended state shown in FIG. 2 and the stowed collapsed state shown in FIG. 3. Collapsing the firearm magazine catch apparatus 10 is accomplished by moving the legs 12 inward towards one another. As the legs 12 are moved inward, the extension arms 32, 34, 36, and 38 fold on one another and cause the sleeve mounts 28 to slide downward along their respective upper leg components 16. Notably, the flexible catch bin 25 may remain attached to the collapsible frame 11 as the frame 11 is transitioned between its extended deployed state and stowed folded state.

The collapsible frame 11 also includes one or more frame locks 70. Each frame lock 70 is mounted immediately below an associated slidable sleeve mount 28. The frame lock(s) 70, when engaged, prevent(s) the sliding movement of the sleeve mounts 28 and thereby retain(s) the apparatus 10 in the deployed extended state of FIGS. 1 and 2. As shown in FIG. 2, a frame lock 70 need not be installed on each leg 12 to prevent collapse of the apparatus 10. It is typically sufficient to use two (2) frame locks 70, though one frame lock 70 may suffice. In FIG. 2, the frame locks 70 are installed on opposite corner legs 12.

Figure 7A:
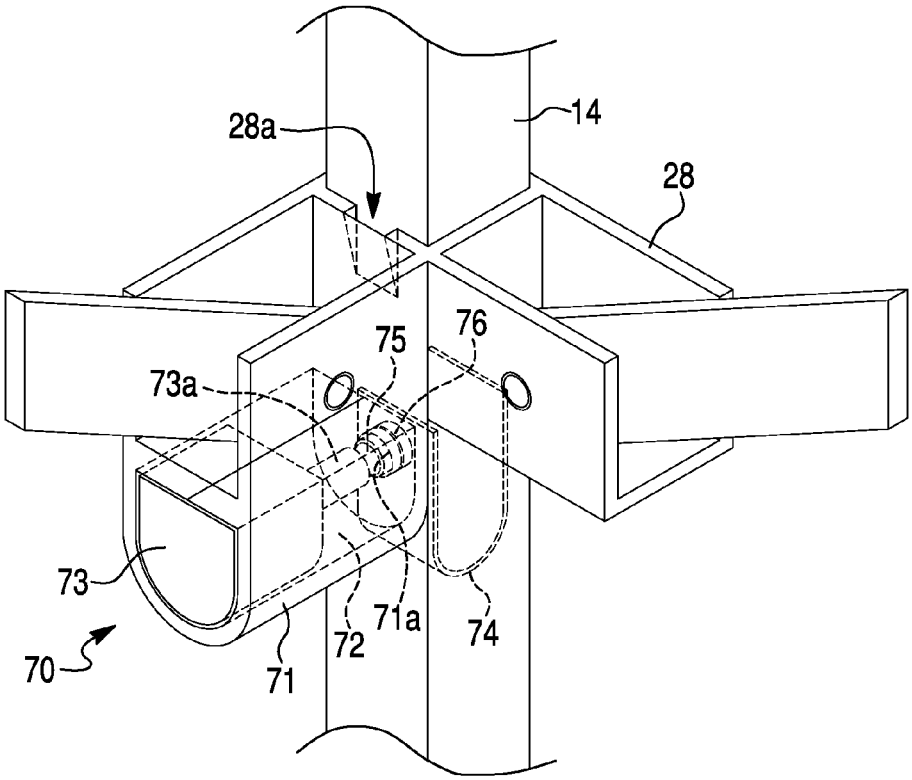
FIGS. 7A and 7B are respectively front perspective and side sectional views of a frame lock.
Figure 7B:
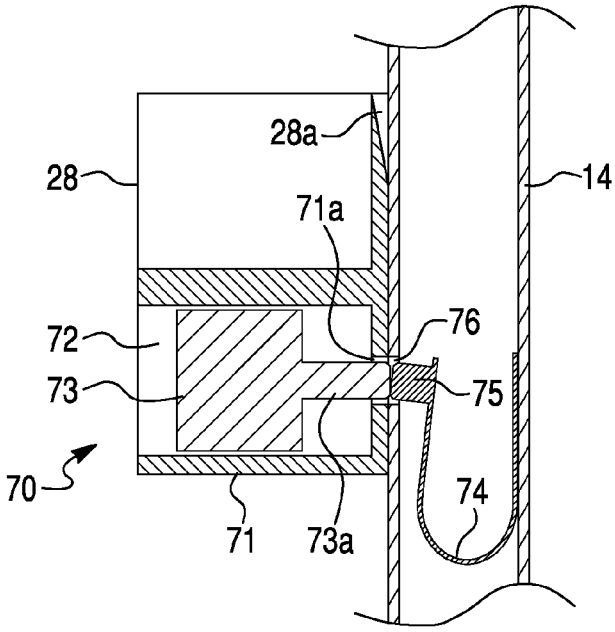

A frame lock 70 according to one exemplary embodiment is shown in FIGS. 7A and 7B. The frame lock 70 includes a slidable lock mount 71 positioned immediately below the slidable sleeve mount 28. The slidable lock mount 71 and the slidable sleeve mount 28 may be integrally formed as a single piece or attached to one another, for example, with a fastener, weld, and/or adhesive. The lock mount 71 and the sleeve mount 28 are slidable along the upper leg component 14 in tandem with one another. The slidable lock mount 71 includes a U-shaped cavity 72 in which a lock release 73 is received. The lock release 73 is slidable from the front of the cavity 72 (as shown in FIG. 7A) towards the rear of the cavity 72 (as shown in FIG. 7B) for actuating the release function of the lock release 73 so that the apparatus 10 may be collapsed. The lock release 73 may be thumb-sized for easy actuation by the user. The back side of the lock release 73 includes a stem 73*a* that is axially aligned with a through hole 71*a* in the rear wall of the slidable lock mount 71.

A biasing member 74 housed in the upper leg component 14 is connected to a locking stud 75. The biasing member 74 urges the locking stud 75 through a lock hole 76 in the upper leg component 14. The biasing member 74 may be a compression spring or leaf spring, as discussed above, and is housed in the hollow portion of the upper leg component 14. The locking stud 75 is cylindrical with a diameter slightly smaller than the diameters of the lock hole 76 and the through hole 71*a* and a length greater than the axis of the lock hole 76. The biasing member 74 urges the locking stud 75 to protrude through the lock hole 76, for example, by about 0.64 cm (0.25 inch). The firearm magazine catch apparatus 10 is retained in the deployed extended state of FIGS. 1 and 2 by positioning the slidable lock mount 71 so that its through hole 71*a* is aligned with the lock hole 76, such that the locking stud 75 protrudes through the lock hole 76 into the through hole 71*a* to prevent sliding movement of the lock mount 71.

To collapse the apparatus 10 into the stowed collapsed state of FIG. 3, the lock release 73 is depressed, causing the stem 73*a* to overcome the urging force of the biasing member 74 and push the locking stud 75 into the lock hole 76 such that the locking stud 75 is disengaged from the through hole 71*a*. With the frame locks 70 disengaged, two opposite legs 12 or their stationary support mounts 26 are pushed towards one another to cause the sleeve mounts 28 and the lock mounts 71 to slide downward along the upper leg component 14 as the truss structure 24 folds inward.

To extend the apparatus 10 from its stowed collapsed state back into its deployed extended state, two opposite legs 12 or stationary support mounts 26 are pulled apart from one another in opposite directions. As the sleeve mounts 28 and the lock mounts 71 slide upward along the upper leg component 14, the truss structure 24 expands. As best shown in FIGS. 7A and 7B, the top edge of the rear surface of the slidable sleeve mount 28 includes a graded groove 28*a* that is sufficiently deep at its upper end to receive the protruding portion of the locking stud 75 as the mounts 28 and 71 slide upward along the upper leg component 14. The graded grooves 28*a* receive and depress the locking studs 75 so that the studs 75 do not interfere with deployment of the apparatus 10. The mounts 71 continue to travel up until the through holes 71*a* of the sliding lock mounts 71 come into alignment with the locking studs 75 and the lock holes 76. The biasing members 74 urge the locking studs 75 into the through holes 71*a* to lock the mounts 71 in placed and retain the apparatus 10 in its extended deployed position until such time as the lock release 73 is actuated by the user.

Figure 8:
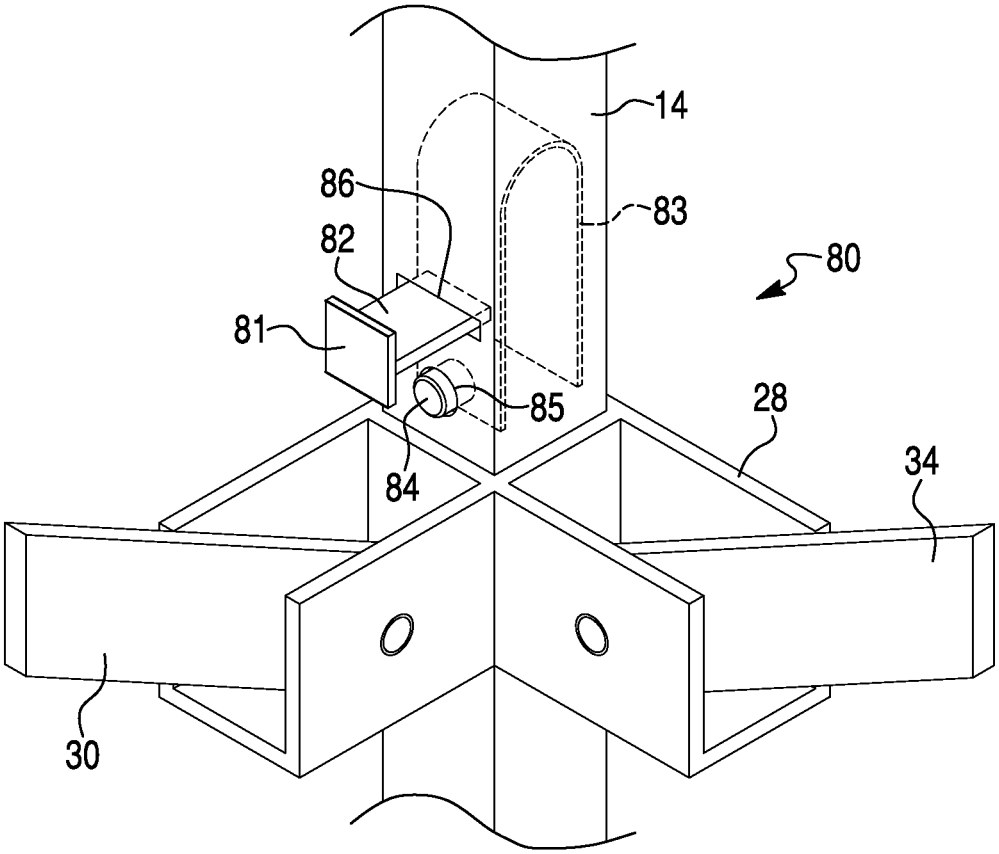
FIG. 8 illustrates an alternative embodiment of a frame lock.

Another embodiment of a frame lock 80 is illustrated in FIG. 8. The frame lock 80 includes a lock release 81, a stem 82, a biasing member 83, and a locking stud 84 protruding through a lock hole 85 in the upper leg component 14. The biasing member 83 is housed within the upper leg component 14, while the lock release 81 is accessible outside of the upper leg component 14. The stem 82 extends through a slot 86 in the upper leg component 14. The biasing member 83 may be a leaf spring or coil spring, for example. The lock release 81, the stem, 82, and the biasing member 83 may be integrally formed as a single metal strip, with the locking stud 84 attached, adhered, welded, integrally formed, or otherwise joined to an end portion of the biasing member 83. The frame lock 80 operates much in the same manner as the frame lock 70 described above. In a locked state, the locking stud 84 engages a recess (not shown) in the rear surface of the slidable sleeve mount 28. To release the frame lock 80, the lock release 81 is depressed to push the locking stud 84 back into the lock hole 85 and out of engagement with the recess in the rear of the slidable sleeve mount 28.

FIG. 3 shows the collapsible frame 11 in the stowed collapsed state without the flexible catch bin 25. The four legs 12 are in parallel vertical relationship to one another, with the lower leg components 16 fully accommodated in the upper leg components 14 by actuating the locking mechanism 40, 50 or 60 as described above. The frame lock 70, 80 is released as also described above to allow the apparatus 10 to be collapsed. The collection bin 25 does not need be disconnected from the collapsible frame 11 prior to folding the apparatus into its stowed collapsed state. That is, the flexible collection bin 25 and the frame 11 may remain connected to one another when converting the apparatus 10 between its deployed and stowed states.

Returning to FIGS. 1 and 2, the apparatus 10 is shown including an accessory mount 19 designed to accept an accessory rack for accessories, such as table and/or gun holders. The accessory mount 19 may be constructed of a metal, metal alloy, a polymeric material such as a rigid or high impact plastic, or a composite. Although the accessory mount 19 is shown in FIGS. 1 and 2 as a bracket, it may possess other configurations and designs, including that of a mounting hole integrated into the upper leg component 14. One or multiple accessory mounts 19 may be provisioned at various locations about the collapsible frame 11, although the mounts 19 desirably are located below the edge 25*a* of the collection bin 25 so as not to interfere with the catch bin 25 yet out of the range of the sliding sleeve mount 28 so as not to interfere with the collapsing and deploying of the frame 11. As shown, the accessory mounts 19 are positioned on the upper leg components 14 above the sliding range of the slidable sleeve mounts 28. The accessory mounts 19 may be placed on opposite ends and/or opposite sides of the frame 11 so as to allow more individualized combinations of accessory set-ups for both right and left handed shooters. Accessory racks are discussed further below with reference to FIG. 9.

In its deployed extended state, the firearm magazine catch apparatus 10 may be used for catching magazines and capturing rounds that are spilled during magazine changes for many different types of Airsoft weapons. Airsoft weapons rounds are typically spherical plastic BBs, often 6 mm or 8 mm in diameter and weighting approximately 0.20 grams or more. The apparatus described herein is designed to safely capture and retain all types of magazines and spilled rounds designed for and fired by various Airsoft weapons. Advantageously, the apparatus 10 of the above-described embodiment is constructed as a free-standing, independent device with an open top. The different adjustment and collapsibility features (e.g., the telescoping legs 12, the articulation provided by the swivel foot mounts 20) impart high adaptability, making the apparatus 10 height-adjustable for different size users, adaptable for use on uneven surfaces, portable for easy stowing and transport, and compatible for use with different types of Airsoft firearms. For example, it may be desirable to arrange the legs 12 at a higher setting for pistols than for rifles. Further, a higher setting may be used when firing from a standing position than from a kneeling position.

In use, the apparatus 10 may be setup widthwise in front of the forward foot of the shooter. As magazines are removed from a firearm's magazine well, the magazines and any BBs in the so-called dead space are dropped straight down into the flexible catch bin 25, which is shown supported above the ground so that the magazines are BBs are safely caught without being damaged. The catch bin 25 may accommodate magazines of all shapes and sizes. The dropped magazines and BBs gather at the center of the catch bin 25 for easy removal and reuse. The mobility and relatively small size of apparatus 10 allow Airsoft shooters to set up improvised shooting ranges in areas that otherwise would not be suitable due to their surroundings. The apparatus described herein are ideal for use in indoor applications, such as in basements, garages, and small training areas.

The depression 24*a* in top edge of the "front side" of the truss structure 24 may be placed closest to the shooter. The depression 24*a* creates a notch (or void) in the front wall of the apparatus 10 that allows the shooter to transition from a primary weapon such as a rifle or carbine to a secondary weapon such as a pistol without the barrel of the primary weapon striking the catch bin 25 as it is being lowered. The depression 24*a* should be sufficient in depth so that the barrel of the primary weapon does not strike the inside of the catch bin 25 or the truss structure 24 during transition, i.e., as the primary weapon is being lowered and released by the shooter.

Figure 9:
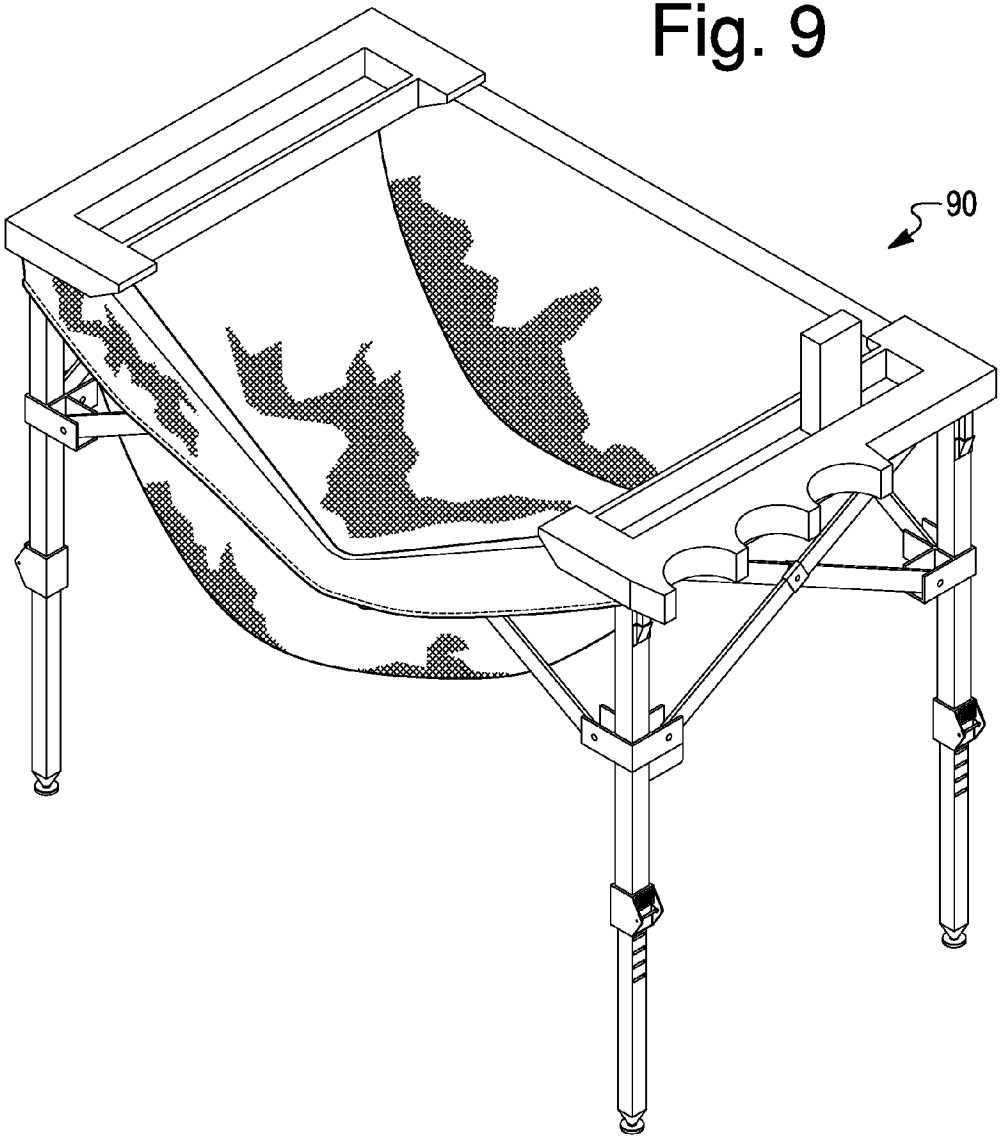
FIG. 9 is a perspective view of a firearm magazine catch apparatus according to another exemplary embodiment.

FIG. 9 is a perspective view of embodiment of a firearm magazine catch apparatus 90 according to another embodiment of the invention, in which an accessory rack or table is mounted on a bracket such as accessory mount 19 described above. Components and features that the apparatus 90 has in common with apparatus 10 are described above and incorporated herein by reference. The accessory rack may include modular components to enhance the device functionality, such as tabletops with mounts, props for pistols, wells for magazines and ammunition, and rifle barrel rests. Interchangeable mounts may be provided for holding different size weapons, magazines, ammunition, and accessories.

Modifications and variations to the embodiments described above may be practiced and should be considered part of this disclosure. Various features described above with respect to the exemplary embodiments are optional. For example, although the frame 11 is described as being collapsible and height adjustable, the firearm magazine catch apparatus 10 may include a non-collapsible and/or non-adjustable frame. The depression 24*a* may be eliminated from the truss structure 24. The accessory mounts 19, swivel foot mounts 20, feet 22, and reinforcement edging 25*a* are examples of other optional components.

The apparatus 10 is discussed above for use in connection with catching Airsoft magazines. It should be understood that the apparatus 10 may also be used with genuine firearms. The apparatus 10 may be made of higher strength materials if its intended use is for real firearms. The apparatus also may be used as a brass catcher for catching discharged shells. For use as a brass catcher, the apparatus may be relocated to the side and slightly behind the shooter.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to limit the invention to the precise embodiments disclosed. The specification describes specific examples to accomplish a more general goal that may be accomplished in another way.

Only those claims which use the words "means for" are to be interpreted under 35 USC 112, sixth paragraph. Moreover, no limitations from the specification are to be read into any claims, unless those limitations are expressly included in the claims.

What is claimed is:

1. A firearm magazine catch apparatus movable between a deployed extended state and a stowed collapsed state, comprising:

a frame comprising a frame structure and a plurality of legs interconnected by and supporting the frame structure in the deployed extended state, the frame structure comprising a plurality of arms that collectively form an upper opening, the arms comprising adjacent first and second sloping arms directly connected to one another at a pivot joint between adjacent first and second legs of the plurality of legs; and a flexible collection pouch suspended from the frame in the upper opening to hang above the ground when the firearm magazine catch apparatus is in the deployed extended state, the flexible collection pouch comprising an open top and a plurality of walls, the open top of the flexible collection pouch in the deployed extended state being defined by a plurality of top edges overlying the plurality of arms, the top edges in the deployed extended state comprising a first top edge that slopes downward over the first and second sloping arms to establish a depression along the first top edge with a bottom of the depression overlying the pivot joint and a non-sloping second top edge on an opposite side of the upper opening relative to the first upper edge, the walls of the flexible collection pouch sloping from the top edges to a central area of the frame structure for catching firearm magazines discharged from a firearm.

2. The firearm magazine catch apparatus of claim 1, wherein the legs comprise a plurality of telescoping components.

3. The firearm magazine catch apparatus of claim 1, further comprising a frame lock for automatically locking the frame structure in the deployed extended state, the frame lock including a release for releasing the frame structure from the deployed extended state so that the frame structure may be moved into the stowed collapsed state.

4. The firearm magazine catch apparatus of claim 1, wherein the depression has a V-shaped configuration sloping downward from the legs to approximately a midpoint of the first side of the frame structure.

5. The firearm magazine catch apparatus of claim 1, wherein the flexible collection pouch comprises a mesh or fabric.

6. The firearm magazine catch apparatus of claim 1, further comprising hook-and-loop fasteners for connecting the flexible collection pouch from the frame.

7. A method of prolonging the lifespan of a firearm magazine, comprising:

catching a firearm magazine ejected from a firearm in the firearm magazine catch apparatus of claim 1.

8. The firearm magazine catch apparatus of claim 1, wherein the first and second sloping arms have respective lower ends pivotally connected to one another.

9. The firearm magazine catch apparatus of claim 8, wherein the first and second sloping arms collectively extend between and to first and second legs of the plurality of legs.

10. A firearm magazine catch apparatus, comprising:

a frame comprising a truss frame structure and a plurality of legs interconnected by and supporting the truss frame structure, the truss frame structure being movable between a deployed extended state and a stowed collapsed state, the truss frame structure comprising a plurality of arms that collectively form an upper opening, wherein when in the deployed extended state the arms on a first side of the truss frame structure comprise adjacent first and second sloping arms directly connected to one another at a pivot joint between adjacent first and second legs of the plurality of legs; and a flexible collection pouch suspended from the frame in the upper opening to hang above the ground when the firearm magazine catch apparatus is in the deployed extended state for catching firearm magazines discharged from a firearm, the flexible collection pouch comprising an open top and a plurality of walls, wherein in the deployed extended state the open top of the flexible collection pouch is defined by a plurality of top edges overlying the plurality of arms, the top edges comprise a first top edge that slopes downward over the first and second sloping arms to establish a depression along the first top edge and a non-sloping second top edge on an opposite side of the upper opening relative to the first upper edge, and the walls of the flexible collection pouch slope from the top edges to a central area of the frame structure for catching firearm magazines discharged from a firearm.

11. The firearm magazine catch apparatus of claim 10, wherein in the deployed extended state the depression has a V-shaped configuration sloping downward from approximately the legs to a midpoint of the first side of the frame structure.

12. The firearm magazine catch apparatus of claim 10, wherein the legs comprise a plurality of telescoping components.

13. The firearm magazine catch apparatus of claim 10, further comprising a frame lock for automatically locking the frame in the deployed extended state, the frame lock including a release for releasing the frame from the deployed extended state so that the truss frame may be transitioned into the stowed collapsed state.

14. The firearm magazine catch apparatus of claim 10, wherein the flexible collection pouch comprises a mesh or fabric.

15. The firearm magazine catch apparatus of claim 10, further comprising hook-and-loop fasteners for connecting the flexible collection pouch from the frame.

16. A method of prolonging the lifespan of a firearm magazine, comprising:

catching a firearm magazine ejected from a firearm in the firearm magazine catch apparatus of claim 11.

17. The firearm magazine catch apparatus of claim 10, wherein the first and second sloping arms have respective lower ends pivotally connected to one another.

18. The firearm magazine catch apparatus of claim 17, wherein in the deployed extended state the first and second sloping arms collectively extend between and to first and second legs of the plurality of legs.

* * * * *